US005092760A

United States Patent [19]

Brown et al.

[11] Patent Number: 5,092,760

[45] Date of Patent: Mar. 3, 1992

[54] OXYGEN-FUEL BURNER ASSEMBLY AND OPERATION

[75] Inventors: John T. Brown, Corning, N.Y.; William P. Coppin, Muncie, Ind.

[73] Assignees: Maxon Corporation, Muncit, Ind.; Corning Incorporated, Corning, N.Y.

[21] Appl. No.: 561,319

[22] Filed: Aug. 1, 1990

[51] Int. Cl.[5] ..... F23M 3/04

[52] U.S. Cl. ..... 431/10; 431/187; 431/188; 431/354; 239/132.5; 239/422; 239/424.5

[58] Field of Search ..... 431/115, 116, 10, 2, 431/4, 354, 181, 187, 188, 190; 239/402–405, 423, 424.5, 132.5, 422, 425

[56] References Cited

U.S. PATENT DOCUMENTS

| | | | |
|---|---|---|---|
| 2,672,190 | 3/1954 | Schumann | 431/188 |
| 2,815,069 | 12/1957 | Garraway | 431/188 |
| 3,787,168 | 1/1974 | Koppang | 431/115 |
| 3,809,525 | 5/1974 | Wang et al. | 431/353 |
| 3,817,685 | 6/1974 | Joannes | 431/116 |
| 4,017,253 | 4/1977 | Wielang et al. | 431/10 |
| 4,230,449 | 10/1980 | Binasik et al. | 431/353 |
| 4,541,796 | 9/1985 | Anderson | 431/351 |
| 4,559,009 | 12/1985 | Marino et al. | 431/187 |
| 4,690,635 | 9/1987 | Coppin | 431/353 |
| 4,726,760 | 2/1988 | Skoog | 431/187 |
| 4,815,966 | 3/1989 | Janssen | 431/115 |

*Primary Examiner*—James C. Yeung
*Attorney, Agent, or Firm*—Burton R. Turner

[57] ABSTRACT

An oxygen-fuel burner is disclosed wherein the atomizing fluid no only atomizes a liquid fuel, but also functions to cool the burner tip and prevent eddying of the atomized fuel from collecting on the burner tip, which could create undesirable high temperatures upon ignition. Further, oxygen may be utilized as an atomizing fluid in view of the fact that the atomization of the fuel is accomplished so close to the discharge end of the burner and the discharge velocity is maintained at such a high level, that the contact time of the oxy-fuel within the burner is extremely short, thereby precluding preignition within the burner. Further, the oxygen itself also functions to cool the burner tip and prevent preignition or cracking of the liquid fuel in the atomizing chamber. The burner may be utilized with carbon dioxide as an atomizing fluid wherein the burner temperature is thus lowered reducing the amount of $NO_x$ produced, and the spent gases may be recovered and recycled as the atomizing fluid, in view of the fact that such gases are predominantly $\frac{1}{3}CO_2$ and $\frac{2}{3}H_2O$.

25 Claims, 3 Drawing Sheets

OXYGEN-FUEL BURNER ASSEMBLY AND OPERATION

BACKGROUND OF THE INVENTION

This invention relates to oxygen-fuel burners in general, and more specifically to burners utilizing oxygen, as opposed to air, as the oxidizing agent for the fuel; and a liquid fuel such as oil, or a dispersion of solid fuel in a fluid medium, which necessitates the atomization of the fuel so as to promote complete efficient combustion of the fuel when mixed with the oxidant, hereinafter referred to as oxy-oil burners. The oxy-oil burners of the present invention are not liquid cooled, but have a wide range of flow rates while maintaining safe burner tip temperatures.

The prior art is replete with burner assemblies of different configurations, however, most of such burners relate to oxy-gas or air-oil operations rather than the unique concerns of the oxy-oil burner of the present invention.

U.S. Pat. No. 3,809,525 relates to a flat-flame burner utilizing an air-oil combustion mixture, wherein the burner tip is provided with helicoid passages for atomizing fuel oil droplets and mixing with eddying secondary air escaping adjacent the tip.

U.S. Pat. No. 4,230,449 discloses a low pressure air-oil burner capable of generating a relatively long narrow flame. An atomizer, having a venturi and a swirl plate to atomize a fuel oil, is positioned within a primary air chamber so as to provide a distribution which is not rotationally symetric about the chamber axis, and therefore is not subject to stability and vibration problems.

U.S Pat. No. 4,541,796 relates to an oxygen-oil aspirator burner and discusses the advantages and disadvantages of oxygen replacing air for combustion. The principal advantages noted are an increase in the maximum achievable firing rate, a decrease in fuel consumption and a decrease in pollution problems relating to entrainment of particles, as well as a decrease in the nitrogen portion in both the oxidant and flue gas. However, the noted disadvantages included a lower gas momentum in the furnace and higher flame temperatures which produce local hot spots and increase nitrogen oxide ($NO_x$) emissions. In order to overcome the disadvantages and utilize the advantages of oxygen, the patent discloses the use of oxygen jets introduced at a velocity sufficient to cause aspiration of furnace gases into the oxidant jets before the latter mix with the fuel jet, in amounts sufficient to lower flame temperature.

U.S. Pat. No. 4,690,635 relates to a high temperature oxy-gas burner assembly wherein the gas conduit tip has a frusto-conical portion forming a knife edge for briefly delaying combustion, which tip is surrounded by a plurality of oxygen emitting holes disposed in a circular array or an annular shaped oxygen emitting orifice, or both.

U.S. Pat. No. 4,726,760 relates to an air-oil burner wherein the oil is formed into minute fuel particles in the form of a spray cone, by being discharged through a central port which is defined by a continuous knife edge. The spray cone is bounded by an external rotating flow of air.

In order to overcome the problems and complexities with the above-noted burner assemblies of the prior art, it is an object of the present invention to provide an oxy-oil burner having a wide range of flow rates and which maintains an acceptable cool body tip temperature, even at relatively low flow rates and even when oxygen is used as the atomizing fluid, without the use of liquid cooling.

Operationally, the improved structure of the present oxy-oil burner permits the previously unthinkable use of commercially pure oxygen or oxygen enriched gases as the atomizing fluid, by providing a boundary layer annulus which precludes fuel "cracking" in the atomizing chamber and prevents the collecting of minute oil particles adjacent the burner tip. Further, by utilizing carbon dioxide as the atomizing fluid, not only are acceptable burner tip temperatures produced, but also the resulting flame temperature is reduced thus producing an overall reduction in $NO_x$.

SUMMARY OF THE INVENTION

In its simplest form, the present invention sets forth a new concept in oxy-oil burner assemblies which have particular use in glass and metallurgical furnaces and steam generators. When liquid hazardous wastes or oil are utilized as the liquid fuel, they must be atomized into minute particles in order for the oxidant to provide complete and efficient burning of the fuel. Further, when oxygen is utilized to support combustion, rather than standard air, the flame temperatures produced are extremly high compared to those burners merely using air. Previously, oxygen was not considered to be a feasible atomizing agent, due to the rapid ignition of the oxy-fuel mixture, prior to desired ignition, which would result in the production of detrimental temperatures to critical components of the burner, including the burner tip.

In the present construction, the preignition of liquid fuel particles atomized by commercially pure oxygen or oxygen enriched gases, is prevented by means of: (1) the utilization of a boundary layer cooling annulus which encompasses and flows about a discharge cone positioned adjacent to a radiation shield at the burner tip, and (2) a short transport distance and a high discharge velocity. The boundary layer not only cools the radiation shield, but also cools the discharge cone inserted in the atomized oil outlet port, and thus precludes preignition and fuel cracking within the atomizing chamber. In addition, the thin envelope of oxygen or oxygen enriched gases issuing through a boundary layer passage also protects the burner tip by preventing the minute oil particles from eddying and collecting on the adjacent radiation shield, which collection could become a fuel source in the presence of oxygen, thus producing damaging quantities of heat to the burner and adjacent structure. Further, by extending the atomized oil outlet of the burner tip outwardly beyond the discharge of the combustion oxygen, combustion of the oil is delayed, thus not only lowering the temperature of the burner tip but also reducing fuel cracking.

The invention also permits the utilization of oxygen as an atomizing medium by virtue of a very short transport distance and by the maintenance of a high discharge velocity of the atomized fuel, thereby precluding preignition of the oxygen-atomized fuel particles within the burner chamber. The transport distance is the distance wherein the fuel and oxygen are in intimate contact within the burner, and such distance is preferrably maintained at less than ¾ of an inch. Further, in view of the high velocity of the oxygen-atomized fuel particles, of upwards of 600 feet per second, the atomizing oxygen and fuel are generally in contact for less than 0.0001 seconds within the burner. Thus, since the time and distance over which the combustible mixture is transported within the burner is extremely short, oxygen can be used as the atomizing fluid without the danger of preignition.

DESCRIPTION OF THE PREFERRED EMBODIMENTS

The burner unit of the present invention is particularly characterized by a discharge cone positioned within the outlet end of the fuel assembly downstream of an atomizing member, which discharge cone is surrounded by a radiation shield. The discharge cone is positioned within the outlet passage of the fuel oil assembly with an annular passageway maintained between it and the radiation shield to form a boundary layer cooling annulus between the radiation shield and the discharge cone, which is discharged about the atomized oil adjacent the burner tip. The boundary layer cooling annulus, which is formed by the medium utilized to atomize the oil into minute fuel particles, functions to cool the radiation shield and the discharge cone and preclude the cracking or coking of fuel in the atomizing chamber, as well as preventing the eddying of the minute particles from collecting on the radiation shield surrounding the burner tip.

Figure 1:
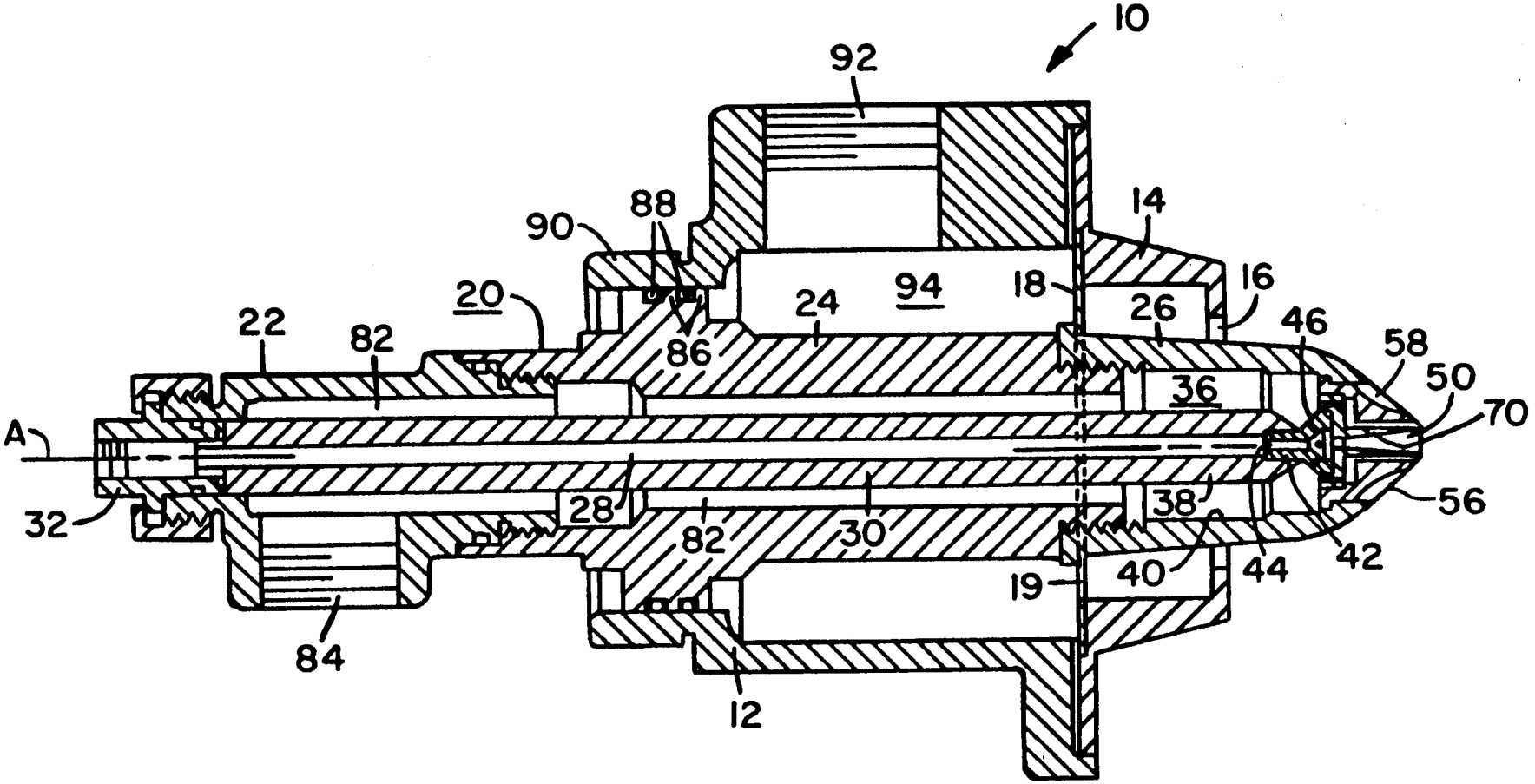
FIG. 1 is a cross-sectional view of an oxy-oil burner assembly embodying the present invention.
Figure 2:
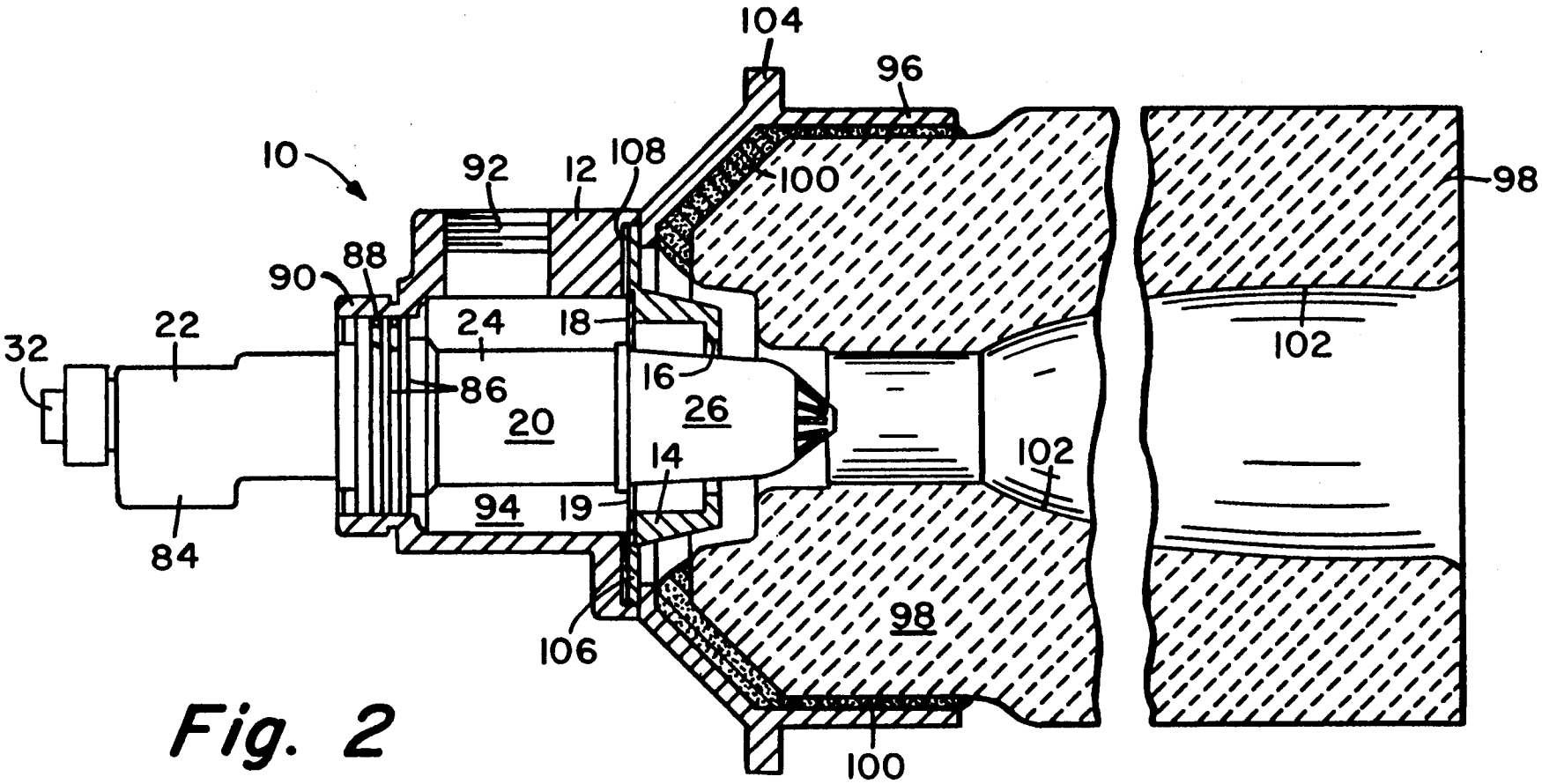
FIG. 2 is an elevational view, partially in section, of a burner unit embodying the present invention associated with a burner block.
Figure 3:
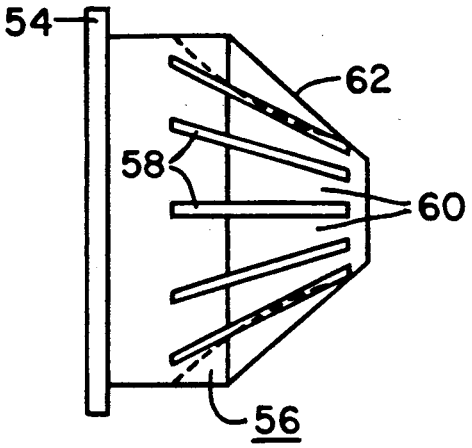
FIG. 3 is elevational view of the finned radiation shield forming a part of the present invention.
Figure 4:
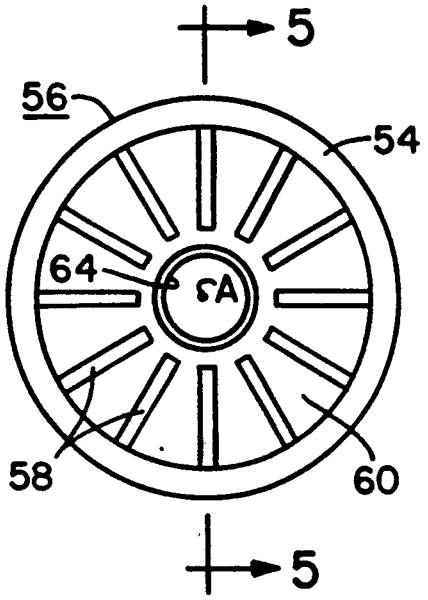
FIG. 4 is an end elevational view of the radiation shield shown in FIG. 3.
Figure 5:
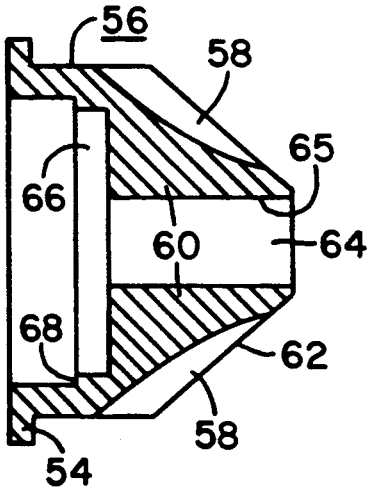
FIG. 5 is an elevational view in section taken along line 5—5 of FIG. 4.

As shown in FIGS. 1 and 2, the complete burner unit or assembly 10 of the present invention includes a housing 12 having a nose portion or nose piece 14 provided with a central discharge orifice or annular opening 16. A fuel or oil delivery assembly 20 is shown centrally mounted within the housing 12 by means of a spider or centering ring 18. The fuel delivery assembly 20 is shown comprising an inlet body portion 22, a central body portion 24 and a burner tip portion 26. A central fuel-oil passageway 28, formed in a channel member 30, is provided with an inlet connector 32 for receiving a suitable supply of fuel such as oil. The central fuel-oil passageway 28 extends through the fuel delivery assembly 20 along a central axis A.

The burner tip portion 26 forms a chamber 36 between a forward channel portion 38 of the channel member 30 and the inner circumferential wall portion 40 of the burner tip portion 26. As shown more particularly in FIG. 6, an atomizing member 42 is secured to an outlet end of the forward channel portion 38 and projects within the central fuel-oil passageway 28. The atomizing member 42 has a central passageway or oil port 44 communicating with the central fuel-oil passageway 28, which is coaxial with the axis A of the central fuel-oil passageway. The atomizing member has diverging wall portions 46 provided with atomizing ports 48 which converge toward the central axis A adjacent the outlet of oil port 44.

The forward end of the burner tip portion 26 terminates at its outer end in a burner tip opening 50, which is stepped internally at 52 to receive a flange 54 of a ribbed or finned annular radiation shield 56. As shown more particularly in FIGS. 3–6 inclusive, the radiation shield 56 has a plurality of grooves 58 formed in a tapered nose portion 62 providing a plurality of cooling fins or ribs 60 extending radially outwardly about central axis A. The radiation shield 56 has a central opening 64 communicating with a recessed portion 66 and a stepped portion 68.

Figure 6:
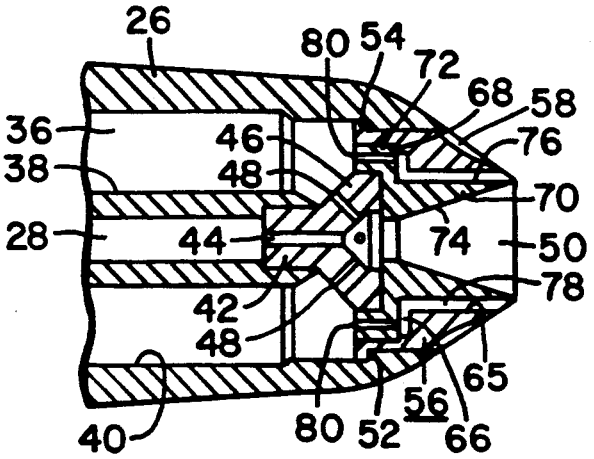
FIG. 6 is fragamental cross-sectional view in elevation showing in more detail the forward or outlet end of the burner.

A discharge cone 70 is positioned within the central opening 64 of the radiation shield 56. The discharge cone 70 has a retaining flange 72 which is positioned between the atomizing member 42 and the stepped portion 68 of the radiation shield 56. The discharge cone 70 has an inner conical surface 74, concentric with axis A, which diverges outwardly toward the burner tip opening 50, permitting the atomized fuel to expand adjacent the outlet end of the fuel delivery assembly 20. An outer surface 76 of the discharge cone is spaced-apart from an inner surface portion 65 of the central opening 64 so as to form an annular passage 78 between the discharge cone 70 and the annular radiation shield 56 adjacent the burner tip. The annular passage 78 extends concentrically with, and accordingly parallel to, the central axis A of the central fuel-oil passageway 28 and oil port 44. The annular recess 66, formed in the radiation shield 56, communicates with a plurality of ports 80 formed in the retaining flange portion 72 of the discharge cone 70, which ports are in open communication with the chamber 36. As shown in FIG. 6, the annular recess 66 is not only in communication with the plurality of ports 80, but also the annular passage 78 formed between the discharge cone 70 and the annular radiation shield 56.

An atomizing fluid passage 82, extends through the inlet body portion 22 and central body portion 24 of the fuel assembly 20 exteriorily of channel member 30, and communicates at its outlet end with the chamber 36 formed between the burner tip portion 26 and the channel member 30. The atomizing fluid passage 82 is provided at its inlet end with a connector 84 for receiving a suitable supply of atomizing fluid. As shown particularly in FIG. 1, the centering ring or spider 18 is provided with a plurality of openings or ports 19 for the flow of oxygen outwardly along the outer surface of burner tip portion 26. The outer surface of the burner tip portion 26 between the centering ring 18, and the radiation shield 56, is tapered at about 4° to provide a smooth transition flow for the combustion oxygen to the radiation shield 56 which is provided with the ribs 60 to facilitate cooling, and protect the burner from the effects of detrimental heat.

As also shown particularly in FIG. 1, the fuel delivery assembly 20 is positioned with its central body portion 24 within the housing 12, and with the burner tip portion 26 axially centered with and extending outwardly through the central annular opening 16, such that the annular discharge orifice 16 is coaxial with the axis A of the central fuel-oil passageway 28. The central body portion 24 is shown being provided with flange portions 86 having one or more O-rings 88 positioned therewithin for sealing the oil delivery assembly 20 with an inner lip portion 90 of the housing 12.

An oxygen inlet 92 is provided within the housing 12 and communicates with an oxygen supply chamber or manifold 94 which surrounds the central body portion 24 and the burner tip portion 26 of the fuel delivery assembly 20. The oxygen supplied to the chamber 94 exits through the plurality of oxygen ports or openings 19 formed in the spider or centering ring 18, so as to provide an oxygen envelope about the atomized oil discharged from the outlet end 50 of the fuel assembly 20.

As noted in the present construction, the burner tip portion 26 is not only centered within the nose portion 14 of the housing, but also projects through and extends outwardly beyond the central discharge orifice 16 formed in the nose piece 14 of the housing 12. In view of the fact that the oxygen discharged through orifice 16 must flow along the tapered outer surface of the burner tip portion 26 for a distance of up to about 1½", there is a delayed combustion produced between the atomized fuel particles supplied through the discharge cone 70 and the oxygen supplied through the central orifice 16 of the nose piece 14 surrounding the tip, thereby lowering the burner tip temperature to satisfactory levels. In addition, the flow of the oxygen past the cooling fins or ribs 60 further functions to materially cool the burner tip portion 50.

The housing 12, as shown more particularly in FIG. 2, may be connected to a retainer or support block holder 96 having a refractory burner block 98, such as stabilized zirconia, and retained thereby with a suitable cement 100. The burner block 98 is provided with a combustion chamber 102. The retainer or support block holder 96 has a flange portion 104 for attachment to the wall of a furnace or steam generator. The nose piece 14 has a mounting flange 106 adjacent its inlet end, which is suitably secured to the housing 12 and a gasket 108 is provided therebetween.

In operation, a suitable fuel such as oil is supplied to the inlet connector 32 of the central oil passageway 28 and flows along the passageway 28 into the oil port 44 of the atomizing member 42. Simultaneously, an atomizing medium is supplied to connector 84 and flows through atomizing passage 82 into chamber 36. From chamber 36, a portion of the atomizing fluid medium flows through the plurality of atomizing ports 48 in the diverging walls 46 of the atomizing member 42 to impinge upon the axial flow of oil passing through the central oil port passageway 44, so as to atomize the oil into a plurality of minute particles. The atomized oil particles then expand within the discharge cone 70 as they leave the outlet end of the fuel assembly 20 adjacent the burner tip opening 50. However, a portion of the atomizing fluid is also delivered through the plurality of ports 80 in the retaining flange portion 72 of the discharge cone 70, through the annular recess 66, and outwardly through the annular passage 78 to form a boundary layer cooling annulus about the atomized oil particles discharged from the burner opening 50.

The boundary layer cooling annulus of atomizing media, formed by the annular passage 78, flows concentrically about the discharged atomized oil particles and coaxially with the axis of the central oil passageway 28 and oil port 44. The boundary layer cooling annulus not only functions to stabilize the flow of atomized oil particles discharged from outlet 50 and restrains the eddying of such minute oil particles from collecting on the radiation shield 56, but also cools the radiation shield and the discharge cone, and precludes the fuel from cracking in the atomizing chamber. It is important that the oil particles do not collect on the radiation shield, since any collection of carbon becomes a fuel source, particularly in the presence of oxygen, with the resultant release of damaging quantities of heat. Further, simultaneously with the discharge of the minute atomized oil particles from the outlet end of the fuel assembly 20, a continuous envelope of commercially pure oxygen is supplied from the oxygen supply chamber 94 and through the openings or oxygen flow ports 19 of centering ring 18 to surround and encompass the discharged atomized oil particles, to form a combustible mixture and produce a desired burner flame.

In the past, air or steam was normally utilized as an atomizing medium, however, argon, carbon dioxide, oxygen or a combination of some or all of such gases may be utilized with the present invention. That is, it was previously not deemed feasible to utilize oxygen as an atomizing medium in view of the rapid ignition or preignition of the fuel/oxygen mixture, resulting in the production of detrimental temperatures to critical components of the burner. With the present invention, however, such problem has not only been resolved through the use of a short transport distance and high discharge velocity, but also by the boundary layer cooling annulus.

As shown particularly in FIG. 6, the atomization of the liquid fuel with the oxygen is done very close to the burner tip itself, and the velocity imparted to the atomized fuel is such so that the time during which the oxygen and fuel are in contact within the burner is extremely short. Accordingly, the danger of unscheduled combustion occurring inside the burner between the atomization process and the burner tip is eliminated. As a specific example, the transport distance wherein the fuel and oxygen are in intimate contact as it passes through the discharge cone 70 is 0.625", and the time from the first oxygen fuel contact to discharge opening 50 is 0.00008 seconds, thus indicating a discharge velocity of 651 feet per second. The boundary layer cooling annulus functions to cool the discharge cone and the tip portion of the burner, thus precluding fuel cracking and preignition in the atomizing chamber. A further benefit, derived from the thin envelop of oxygen issuing through the boundary layer passage 78, is that such boundary layer annulus flow functions to restrain the atomized fuel particles and prevent the eddying of such minute particles from collecting upon the radiation shield 56. Particularly when utilizing oxygen, this is extremely important since any collection of carbon becomes a fuel source in the presence of the oxygen, and upon ignition releases substantially high quantities of heat which would be detrimental to the burner components and surrounding structures.

Although oxygen may now be utilized as an atomizing medium without the problems heretofore encountered, we have found that the use of carbon dioxide as the atomizing medium provides additional benefits. That is, the carbon dioxide ($CO_2$) functions to lower the resulting flame temperature, and therefore a reduction in $NO_x$ is produced, since $NO_x$ production is a function of time and temperature. Carbon dioxide is a non-oxidizing atomizing fluid, and helps delay the ignition of the atomized particles, thus resulting in a lower burner tip temperature. Further, since carbon dioxide is fully oxidized, it will not combine with oxygen or the atomized oil. In addition, carbon dioxide has a relatively higher mass than air or oxygen, in terms of molecular weight, since carbon dioxide has a molecular weight of 44 versus 29 for air and 32 for oxygen. Accordingly, this higher mass provides a greater force to atomize the oil and carry the flow forward. That is, the force to atomize is 37% greater with carbon dioxide than with oxygen at the same fluid velocity.

More importantly, with an oxy-oil burner atomized with $CO_2$, the products of decomposition and combustion in a furnace are predominantly carbon dioxide, once the water is removed. Therefore, by extracting a small portion, less than 10% of the exhaust stream, and cooling such extracted portion to remove water vapor, and compressing the resulting gas, one could provide a continuous source of $CO_2$ as an extremely fine and desirable oil atomizing fluid.

In view of the fact that the products of combustion which may be obtained directly from the furnace are roughly $\frac{1}{3}$ $CO_2$ and $\frac{2}{3}$ water vapor, a continuous supply of $CO_2$ atomizing fluid is available by reconditioning and recirculating the furnace atmosphere. Once the water vapor is removed from the atmosphere, approximately 97% of the resulting dry products is carbon dioxide. Thus, by cooling the furnace atmosphere to remove the water vapor and compressing the resulting product, a continuously available source of approximately 97% $CO_2$ is obtained. Further, water vapor formed from furnace waste heat may also be utilized as an atomizing fluid, as well as natural gas. Again, the lower oxygen content of such fluids produces a cooler operating temperature at the burner tip, which is a very important consideration in order to remove nearly all traces of nitrogen and avoid the formation of $NO_x$ compounds. Thus, air is undesirable due to its 79% nitrogen content.

The discharge angle of the inner conical surface 74 of the discharge cone 70 defines the atomized oil pattern and ultimately the flame shape, as restrained by the boundary layer cooling annulus. The discharge orifice for the atomized oil, and the atomized port size and oil flow rate, dictate the fuel exit velocity. The oxygen port area 16 determines the oxygen velocity. The resulting velocity ratio of fuel to oxygen determines the point of ignition, which is critical to safe tip temperatures in a non-water cooled burner. A one to one ratio is the minimum fuel to oxygen velocity ratio recommended for safe practice. Three to one or higher fuel/oxygen velocity ratings increases the distance between the point of ignition and the tip. This separation of flame from the tip allows operating temperatures commensurate with available commercial materials.

Although the present invention will provide the capability of supplying one to ten million BTU's of energy with 50% or higher available heat for the process, under varying conditions, the following is one specific example of the operation of the burner unit shown in FIG. 1. An oxygen atomizing fluid was supplied through the atomizing fluid passage 82, chamber 36, ports 48, 80, and passage 78 under 50 psig at a flow rate of 350 SCFH. In addition, commercially pure combustion oxygen was supplied by inlet 92 through chamber 94 and ports 19 under 8 psig at a flow rate of 42.7 SCFM. The oil was supplied at a temperature of 70° C., a pressure of 26 psig, and a flow rate of 35 liters per hour.

Although the now preferred embodiments of the invention have been disclosed, it will be apparent to those skilled in the art that various changes and modifications may be made thereto, without departing from the spirit and scope of the invention as set forth in the appended claims.

We claim:

1. A burner assembly for atomizing a fuel and supplying an oxidant for such atomized fuel to produce a combustible mixture and provide a desired flame which comprises:

a fuel delivery assembly;

said fuel assembly including conduit means for providing fuel to be atomized, means connected to said conduit means for atomizing said fuel, outwardly diverging means adjacent an outlet end of said atomizing means for discharging a flow of atomized fuel, and annular passage means surrounding said outwardly diverging discharging means for flowing a boundary layer cooling annulus of atomizing fluid about said means for discharging fuel and adjacent to the discharge flow to restrain such flow and to cool an outlet end portion of said assembly; and chamber means surrounding at least a portion of said fuel assembly for supplying an oxidant to the outlet end of said fuel assembly and for providing an oxidant envelope about said discharging flow of atomized fuel so as to mix with said fuel and provide a combustible mixture with a desired flame.

2. A burner assembly as defined in claim 1 wherein said fuel delivery assembly is positioned within a housing which forms an oxidant supply chamber about a portion of said fuel delivery assembly, a centering ring mounting said fuel assembly within said housing, and a plurality of ports formed through said centering ring for supplying an oxidant to the discharging flow of atomized fuel from said fuel assembly and produce a combustible mixture.

3. A burner assembly as defined in claim 1 including fluid passage means for providing a supply of atomizing fluid to both said atomizing means for atomizing said fuel and said annular passage means for providing a boundary layer cooling annulus about said diverging discharging means such that the atomizing fluid not only functions to atomize the fuel but also functions to cool and protect at outlet end portion of said burner assembly.

4. A burner assembly as defined in claim 1 wherein said means for flowing a boundary layer cooling annulus includes a discharge member positioned in an outlet end of said fuel assembly adjacent to but extending outwardly from said atomizing means, said discharge member forming an annulus passageway along a peripheral portion thereof, and means for providing a source of atomizing fluid to both said atomizing means and said annulus passageway for both atomizing the fuel and for cooling and protecting an outlet end portion of said fuel assembly.

5. A burner assembly as defined in claim 1 wherein said atomizing means is positioned so as to atomize said fuel as it flows along a central axis, said discharging means including means for discharging the atomized fuel in an expanding conical pattern, and said annular passage means for flowing a boundary layer cooling annulus including means for flowing a boundary layer cooling annulus of atomizing fluid concentrically about said central axis and the conical discharge pattern for restraining the flow pattern of discharged atomized fuel.

6. A burner assembly as defined in claim 5 wherein said annular passage means for flowing a boundary layer cooling annulus includes said discharging means in the form of a discharge member positioned in an outlet end of said fuel assembly adjacent to but extending outwardly from said atomizing means, said discharge member forming an annulus passageway thereabout and extending concentrically about said central axis, and means providing a single source of atomizing fluid to both said atomizing means and said annulus passageway for both atomizing the fuel and for cooling and protecting an outlet end portion of said fuel assembly.

7. A burner assembly for atomizing a fuel and supplying an oxidant for such atomized fuel to produce a combustible mixture and provide a desired flame which comprises:

a fuel delivery assembly;

said fuel assembly including means for providing fuel to be atomized, means for atomizing said fuel, means for discharging a flow of atomized fuel, and means for flowing a boundary layer cooling annulus of atomizing fluid about said means for discharging fuel and adjacent to the discharge flow to restrain such flow and to cool an outlet end portion of said assembly;

means for supplying an oxidant to the outlet end of said fuel assembly and for providing an oxidant envelope about said discharging flow of atomized fuel so as to mix with said fuel and provide a combustible mixture with a desired flame, said fuel delivery assembly includes hollow body member portions;

said means for providing fuel to be atomized includes a fuel passageway extending through said body member portions;

said means for atomizing said fuel including an atomizing fluid passage extending through said body member portions, and an atomizing member positioned in an outlet end of said fuel passageway having at least one fuel port and a plurality of atomizing ports, communicating with said atomizing fluid passage, angularly positioned with respect to said fuel port;

a radiation shield positioned within an outlet end of said fuel assembly; and a discharge member positioned within a central opening of said radiation shield, adjacent said atomizing member, and forming an annular passageway between said discharge member and said radiation shield, in open communication with said atomizing fluid passage, to provide an annular boundary layer cooling flow of atomizing fluid adjacent the outlet end of said burner assembly.

8. A burner assembly as defined in claim 7 wherein said discharge member is provided with an inner conical surface which expands outwardly toward the outlet end portion of said burner assembly.

9. A burner assembly as defined in claim 7 wherein said annular passageway surrounds said discharge member, and a plurality of ports extend through a retaining flange portion of said discharge member in communication with said atomizing fluid passage and said annular passageway so as to facilitate the flow of atomizing fluid from said passage outwardly through said annular passageway.

10. A burner assembly as defined in claim 7 wherein said radiation shield includes a plurality of cooling fins formed on an outer nose portion thereof to facilitate the cooling of the burner assembly.

11. A burner assembly for atomizing a fuel and supplying an oxidant for such atomized fuel to produce a combustible mixture and provide a desired flame which comprises:

a fuel delivery assembly;

said fuel assembly including means for providing fuel to be atomized, means for atomizing said fuel, means for discharging a flow of atomized fuel, and means for flowing a boundary layer cooling annulus of atomizing fluid about said means for discharging fuel and adjacent to the discharge flow to restrain such flow and to cool an outlet end portion of said assembly;

means for supplying an oxidant to the outlet end of said fuel assembly and for providing an oxidant envelope about said discharging flow of atomized fuel so as to mix with said fuel and provide a combustible mixture with a desired flame;

said atomizing means is positioned so as to atomize said fuel as it flows along a central axis;

said discharging means including means for discharging the atomized fuel in an expanded conical pattern;

said means for flowing a boundary layer cooling annulus including means for flowing a boundary layer cooling annulus of atomizing fluid concentrically about said central axis adjacent the conical discharge pattern for restraining the flow pattern of discharged atomized fuel;

said fuel delivery assembly includes hollow body member portions;

said means for providing fuel to be atomized includes a fuel passageway extending through said body member portions and along at least a portion of said central axis;

said means for atomizing said fuel including an atomizing fluid passage extending through said body member portions, and an atomizing member positioned in an outlet end of said fuel passageway having at least one central oil port lying along said central axis and a plurality of atomizing ports, communicating with said atomizing fluid passage, angularly directed at said central axis adjacent an outlet end of said oil port;

a radiation shield positioned within an outlet end of said fuel assembly; and a discharge cone positioned within a central opening of said radiation shield, adjacent said atomizing member, and forming an annular passageway between said discharge cone and said radiation shield, in open communication with said atomizing fluid passage, to provide an annular boundary layer cooling flow of atomizing fluid adjacent the outlet end of said burner assembly.

12. A burner assembly as defined in claim 11 wherein said discharge cone is provided with an inner conical surface which lies coaxial with said central axis and expands outwardly toward the outlet end portion of said burner assembly.

13. A burner assembly as defined in claim 11 wherein said annular passageway extends concentrically with said central axis, and a plurality of ports extend through a retaining flange portion of said discharge cone in communication with said atomizing fluid passage and said annular passageway so as to facilitate the flow of atomizing fluid from said passage outwardly through said annular passageway.

14. An oxy-fuel burner comprising:

supply means for supplying liquid fuel;

atomizing means connected to an outlet end of said supply means for atomizing said liquid fuel into a plurality of minute liquid fuel particles;

diverging discharge means adjacent an outlet end of said atomizing means for discharging said plurality of minute liquid fuel particles in a desired flow pattern;

passageway means surrounding said discharge means for providing a boundary layer cooling annulus flow surrounding said discharge flow pattern for cooling said burner;

passage means surrounding at least a portion of said supply means for supplying atomizing fluid to both said atomizing means and said boundary layer cooling annulus flow passageway means for atomizing said liquid fuel and cooling said burner; and chamber means formed in a housing for said burner for supplying oxygen to said plurality of discharged minute liquid fuel particles to form a combustible mixture.

15. An oxy-fuel burner as defined in claim 14 wherein said passageway means for providing a boundary layer cooling annulus flow includes said discharge means in the form of a discharge member positioned adjacent said atomizing means to form an annular passageway surrounding said discharge means adjacent said discharge flow pattern; and said passage means for supplying atomizing fluid communicating with said annular passage for flowing a boundary layer cooling annulus of atomizing fluid about said discharge member and discharge flow pattern.

16. An oxy-fuel burner as defined in claim 14 wherein said means supply for supplying liquid fuel includes means for supplying oil for flow along a central flow axis;

said atomizing means for atomizing said liquid fuel including means for atomizing said oil as it flows along said central flow axis into a plurality of minute oil particles;

said diverging discharge means for discharging said plurality of minute liquid fuel particles including means for discharging a plurality of minute oil particles in a diverging conical pattern concentric with said central flow axis; and said passageway means for providing a boundary layer cooling annular flow including means for providing such flow about said discharge means and said diverging conical discharge pattern, and concentrically with said central flow axis for cooling said burner.

17. An oxy-fuel burner as defined in claim 16 wherein said means for supplying oil includes a body member having a central oil passageway extending therethrough;

said means for atomizing said oil includes an atomizing member positioned adjacent the outlet end of said oil passageway and having a plurality of atomizing ports angularly intersecting said central flow axis; and said means for discharging said plurality of minute oil particles in a diverging conical pattern includes a conical surface with its small end positioned adjacent and in open communication with an outlet end of said atomizing member, which surface is coaxial with said central flow axis and diverges outwardly away from said atomizing member.

18. An oxy-fuel burner comprising:

means for supplying liquid fuel;

means for atomizing said liquid fuel into a plurality of minute liquid fuel particles;

means for discharging said plurality of minute liquid fuel particles in a flow pattern;

means for providing a boundary layer cooling annulus flow surrounding said discharge flow pattern for cooling said burner;

means for supplying atomizing fluid to both said atomizing means and said boundary layer cooling annulus flow means for atomizing said liquid fuel and cooling said burner;

means for supplying oxygen to said plurality of discharged minute liquid fuel particles to form a combustible mixture;

said means for providing a boundary layer cooling annulus flow includes a discharge member positioned adjacent said atomizing means to form an annular passageway surrounding said discharging means adjacent said discharge flow pattern;

said means for supplying atomizing fluid communicating with said annular passage for flowing a boundary layer cooling annulus of atomizing fluid about said discharge flow;

said means for providing a boundary layer cooling annulus flow includes a radiation shield positioned within an outlet portion of said burner assembly; and said discharge member being positioned within a central opening of said radiation shield to form said annular passage therebetween.

19. A method of operating a burner wherein the fuel must be atomized prior to mixing the same with an oxidant for combustion which comprises:

supplying a fuel to be atomized;

providing a source of commercially pure oxygen;

passing a flow of the fuel through at least one fuel port within an atomizing member;

flowing the commercially pure oxygen through a plurality of ports intersecting said fuel flow as the fuel is discharged from said fuel port to atomize the fuel with the oxygen flows through said ports;

discharging the oxygen-atomized fuel from the burner;

flowing a boundary layer cooling annulus of the commercially pure oxygen from said source about said discharging oxygen-atomized fuel and providing cooling to avoid preignition of the oxygen-atomized fuel prior to discharge from the burner; and providing an envelope of oxidant about the discharged fuel to promote combustion.

20. A method of operating a burner as defined in claim 19 including the steps of:

passing the flow of fuel through at least one central port within an atomizing member along a central axis;

flowing the commercially pure oxygen through a plurality of ports angularly intersecting said central axis as the fuel is discharged from said central port to atomize the fuel with the oxygen flows through said angular ports;

discharging the oxygen-atomized fuel from the burner in a conical diverging pattern coaxial with said central axis; and flowing the boundary layer cooling annulus of the commercially pure oxygen concentrically about said central axis and peripherally of said conically diverging discharge pattern.

21. A method of operating an oxy-fuel burner wherein the fuel must be atomized prior to mixing the same with an oxidant for combustion which comprises:

supplying a fuel to be atomized;

providing a source of commercially pure oxygen;

atomizing said fuel with said commercially pure oxygen into a plurality of minute fuel particles adjacent a discharge end of the burner;

maintaining a discharge velocity sufficiently high to preclude the preignition of said oxygen-atomized minute fuel particles prior to being discharged from the burner; and providing an envelope of an oxidant about the discharged fuel to promote combustion.

22. A method of operating a burner as defined in claim 21 wherein the atomization of the fuel is performed at such a short distance from the discharge of the burner and the discharge velocity is maintained at such a level so that the time between atomization and discharge is less than 0.0001 seconds.

23. A method of operating an oxy-fuel burner comprising:

providing a supply of liquid fuel to be atomized;

providing a supply of carbon dioxide atomizing fluid;

atomizing the liquid fuel with said carbon dioxide atomizing fluid and discharging said atomized fuel from said burner;

providing a supply of commercially pure oxygen;

flowing such oxygen about the discharged atomized fuel to form an envelope of oxygen thereabout and mixing the oxygen and atomized fuel to form a combustible mixture.

24. A method of operating a burner as defined in claim 23 including the steps of collecting waste gases from the burner, including water vapor and carbon dioxide, and directly utilizing such collection as an atomizing fluid.

25. A method of operating an oxy-fuel burner comprising:

providing a supply of liquid fuel to be atomized;

providing a supply of carbon dioxide atomizing fluid;

atomizing the liquid fuel with said carbon dioxide atomizing fluid;

providing a supply of commercially pure oxygen;

flowing such oxygen about the atomized fuel to form an envelope of oxygen thereabout and mixing the oxygen and atomized fuel to form a combustible mixture;

collecting the waste gases from said burner, removing the water vapor content therefrom; and compressing the remaining dry gas and recirculating the same into the supply of carbon dioxide atomizing fluid.

* * * * *